United States Patent [19]

Smickley et al.

[11] Patent Number: 4,624,714

[45] **Date of Patent: * Nov. 25, 1986**

[54] MICROSTRUCTURAL REFINEMENT OF CAST METAL

[75] Inventors: Robert J. Smickley, Whitehall; Louis E. Dardi, Muskegon, both of Mich.

[73] Assignee: Howmet Turbine Components Corporation, Greenwich, Conn.

[ * ] Notice: The portion of the term of this patent subsequent to Mar. 19, 2002 has been disclaimed.

[21] Appl. No.: 652,658

[22] Filed: Oct. 31, 1984

Related U.S. Application Data

[63] Continuation of Ser. No. 473,676, Mar. 8, 1983, Pat. No. 4,505,764.

[51] Int. Cl.[4] ..... C22F 1/18

[52] U.S. Cl. ..... 148/3; 148/11.5 F; 148/12.7 B; 148/13; 148/13.1; 148/131; 148/133; 148/20.3; 148/421

[58] Field of Search ..... 148/3, 11.5 F, 12.7 B, 148/20.3, 133, 421, 13.1, 13, 131; 420/417–420

[56] References Cited

U.S. PATENT DOCUMENTS

| | | | |
|---|---|---|---|
| 2,892,742 | 6/1959 | Zwicker et al. | 148/20.3 |
| 3,748,194 | 7/1973 | Ruckle et al. | 148/133 |
| 3,758,347 | 9/1973 | Stalker | 148/4 |
| 4,040,129 | 8/1977 | Steinemann et al. | 420/417 |
| 4,098,623 | 7/1978 | Ibaraki et al. | 148/133 |
| 4,167,427 | 9/1979 | Ueda et al. | 148/133 |
| 4,219,357 | 8/1980 | Yolton et al. | 75/221 |
| 4,482,398 | 11/1984 | Eylon et al. | 148/133 |
| 4,505,764 | 3/1985 | Smickley et al. | 148/133 |

FOREIGN PATENT DOCUMENTS

| | | | |
|---|---|---|---|
| 246538 | 5/1963 | Australia | 420/422 |
| 639963 | 12/1978 | U.S.S.R. | 148/133 |

OTHER PUBLICATIONS

Kelto et al., "Titanium Powder Metallurgy—A Perspective".

Greenspan et al., "Titanium Powder Metallurgy by Decomposition Sintering", Proceedings of the 2nd International Conference, May 2–5, 1972, pp. 365–379.

Kerr et al, "Hydrogen as an Alloying Element in Titanium (Hydrovac)", Titanium '80 Science and Technology, 1980, pp. 2477–2486.

Lederich et al, "Optimum Microstructures for SPF Using Hydrovac", Report MDC Q0753, Sep. 15, 1983, McDonnell Douglas Corp., 76 pages.

Kolachov et al, "The Influence of Hydrogen on Hot Deformability of Titanium Alloys with Different Phase Compositions", Proceedings of the Third International Conference on Titanium, May 18–21, 1976, pp. 1833–1842.

Kolachev, "Hydrogen Embrittlement of Titanium and its Alloys", Proceedings of the Third International Conference of Titanium, May 18–21, 1976, pp. 781–790.

"Hi-Ti Hydrogen Titanium", *Constitution of Binary Alloys*, pp. 799–802, McGraw Hill (1958).

*Primary Examiner*—Wayland Stallard

*Attorney, Agent, or Firm*—Finnegan, Henderson, Farabow, Garrett & Dunner

[57] ABSTRACT

A method of refining the microstructure of metals which undergo a phase transformation at high temperatures by diffusing a solute material into the metal at a temperature below the normal transformation temperature. The solute induces the phase transformation and removal of the solute at a temperature near the transformation temperature reverses the transformation. These phase transformations refine the microstructure of the metal so treated. The method is particularly useful to Group IVB metals i.e. Zr, Hf and Ti.

21 Claims, 13 Drawing Figures

(1) ANNEALED
(2) SOLUTION TREATED AND AGED
(3) PRESENT INVENTION

MICROSTRUCTURAL REFINEMENT OF CAST METAL

This is a continuation of application Ser. No. 473,676, filed Mar. 8, 1983, U.S. Pat. No. 4,505,764.

BACKGROUND OF THE INVENTION

The present invention relates to the use of a temporary or fugitive alloying element to promote a phase transformation in a metal. Hydrogen is of particular interest, particularly with respect to titanium alloys, because it has significant effects on some metal systems and may be removed from the metal after treatment.

Hydrogen has been previously used to modify the properties of titanium and its alloys. It has been used to embrittle titanium to facilitate its comminution by mechanical means to form titanium metal powders. In such techniques hydrogen is diffused into the titanium at elevated temperatures, the metal is cooled and brittle titanium hydride formed. The brittle material is then fractured to form a powder. The powder may then have the hydrogen removed or a compact may be formed of the hydrided material which is then dehydrided, U.S. Pat. No. 4,219,357 to Yolton et al.

Hydrogen also has the effect of increasing the high temperature ductility of titanium alloys. This characteristic has been used to facilitate the hot working of titanium alloys. Hydrogen is introduced to the alloy which is then subjected to high temperature forming techniques such as forging. The presence of hydrogen allows significantly more deformation of the metal without cracking or other detrimental effects, U.S. Pat. No. 2,892,742 to Zwicker et al.

Hydrogen has also been used as a temporary alloying element in an attempt to alter the microstructure and properties of titanium alloys. In such applications, hydrogen is diffused into the titanium alloys, the alloys cooled to room temperatures and then heated to remove the hydrogen. The effect of the temperature of introducing and removing the hydrogen on the structure and properties of titanium alloys was investigated W. R. Kerr et al. "Hydrogen as an Alloying Element in Titanium (Hydrovac)," *Titanium* '80 Science and Technology (1980) p. 2477.

The present invention is directed to the treatment of metal castings subsequent to the casting operation. It is particularly concerned with metal castings using metals or alloys which undergo a solid state allotropic transformation on cooling from elevated temperature, particularly the Group IVB elements and their alloys, including titanium.

In the production of Group IVB element alloy castings such as titanium, it is well known that certain structural imperfections may limit the suitability of the material for its intended applications. This is particularly important in highly stressed, critical applications such as gas turbine engine and other heat engine components, airframe, space vehicle and missile components, and orthopedic implant devices, such as hip joints and knee protheses. These limitations have become increasingly important in recent years because precision castings are being specified more frequently for critical applications because of their intrinsic cost advantage compared to competitive methods of manufacture.

Voids are one general type of imperfection which can exist in Group IVB element castings as a result of microshrinkage, cavity shrinkage, and other effects resulting from solidification. It is well known to those skilled in the art that this type of imperfection can be eliminated by hot isostatic pressing (HIP).

Another type of imperfection which has traditionally limited the utility of Group IVB element castings is unsatisfactory chemical compositional control in surface regions that are in contact with the mold material during solidification. Because of the relatively high chemical reactivity of Group IVB alloys, surface imperfections such as oxygen enrichment, contamination, and alloy depletion effects may be encountered. Within recent years, methods to circumvent this type of difficulty have become generally known. The techniques include the use of more refractory mold materials to limit the extent of surface interaction, and the use of specialized chemical milling treatments to remove desired amounts of surface material in a reproducible manner after casting, and thereby achieve dimensional accuracy in the final part.

A third type of limitation of Group IVB element castings arises because of the influence of the material's allotropic transformation on the casting's solidification history. This results in a microstructure which is coarser than that achieved with deformation processing operations such as forging. Coarse microstructures, in turn, usually are associated with reduced dynamic low temperature properties such as fatigue strength.

With reference to FIGS. 1 and 2, the microstructural coarsening in an unalloyed Group IVB metal (FIG. 1) or a Group IVB based alloy such as Ti-6Al-4V (FIG. 2) arises in the following way. On cooling from the liquid, the material solidifies to form a solid of the high temperature body center cubic (BCC) allotrope, which is referred to herein as beta. On further cooling in the mold, the material reaches the beta transformation (beta transus) temperature ($T_T$ in FIG. 1) where all or part of the beta transforms to the low temperature, hexagonal close packed (HCP) allotrope, which is referred to herein as alpha. In the case of the pure metal (FIG. 1), the as-cast microstructure consists entirely of alpha ("transformed beta") platelets, the orientation of which relate to certain crystallographic planes of the prior beta phase, and the size of which relates to both the cooling time through the transformation temperature and the subsequent cooling rate. In the case of an alloy such as Ti-6Al-4V, (FIG. 2) the material exhibits a coarse two phase microstructure of alpha ("transformed beta") plus beta, because the example alloy contains sufficient alloying element content to stabilize some fraction of the beta to room temperature. In either case, the alpha which has formed is a relatively coarse transformation product of the high temperature beta phase, (hereafter "transformed beta") and it is the coarseness of the alpha which generally limits the mechanical properties of the material, particularly the low temperature dynamic properties such as fatigue strength.

Broadly speaking, there are two conventional ways to address the problem of microstructure coarseness. One is to subject the material to a deformation processing operation such as forging to "break down" and refine the structure. This method has the further advantage that an equiaxed so-called "primary alpha" phase, which traditionally has been unobtainable in a cast structure, can be formed during deformation processing, thereby permitting the achievement of microstructures which are particularly desirable for fatigue limited applications. Unfortunately, forging is an energy, capital and raw material intensive operation. In addition, it is not readily applicable to components designed to be produced as cast net shapes.

A second approach is to heat treat castings above the beta transus temperature (e.g., at temperature $T_1$ in FIGS. 1 and 2) to "solution treat" the material and return it to an all beta structure, and then to cool the article at a relatively rapid rate using either a stream of inert gas or a hyperbaric inert gas chamber. Optionally, this may be followed with one or more intermediate temperature aging treatments. Relatively fine microstructures can be obtained in this way because it is possible to obtain faster cooling rates using an appropriately designed heat treatment furnace than is generally achievable within the mold during and after solidification of the casting.

It is known that both of these approaches may be used to improve the properties of cast materials. As indicated above, castings are characterized by a coarse alpha (transformed beta) microstructure which, except for certain specialized applications, is generally improved by such treatments. Except for certain specialized (e.g., creep limited) applications, thermal treatment above the beta transus temperature is not generally applicable to wrought Group IVB alloys such as titanium alloys because it tends to eliminate the fatigue resistant, recrystallized "primary alpha" microstructure formed during deformation processing and return the material to a transformed beta microstructure.

Unfortunately, heat treatment of Group IVB alloy castings above the beta transus temperature has certain limitations:

(1) There is a tendency to induce beta grain growth which has the undesirable effect of increasing the grain size of the material.

(2) The use of relatively high processing temperatures, which must be performed in a vacuum or inert gas environment, subjects the material to an increased risk of interstitial surface contamination. The extent of this risk tends to increase with increased solutioning temperature.

(3) Due to simple heat transfer considerations, there are section size limitations on the ability to achieve a rapid cooling rate.

(4) The use of rapid cooling rates subjects the material to significant dimensional changes and the risk of distortion and cracking.

The present invention relates to the use of a "catalytic" or "fugitive" solute to induce a phase transformation in a metal and in that manner refine the microstructure without the complications of forging or the limitations of conventional heat treatments. As will be set out in greater detail in following portions of the specification, the solute that has the effect of lowering a transformation temperature is diffused into the metal when it is below a transformation temperature. The presence of the solute causes the transformation and the removal of the solute reverses the transformation.

By example, a removable solute, such as hydrogen, may be used as a temporary alloying element in Group IVB metals and their alloys as a means to promote the alpha to beta or the alpha plus beta to beta phase transformation, and the reverse reactions, under controlled conditions. In this manner microstructural refinement can be obtained under substantially isothermal processing conditions, at temperatures which are significantly below those required for traditional solution treatment and quenching operations.

Such a process is schematically illustrated in FIG. 3 which shows the effect of a solute element which stabilizes the high temperature beta allotrope to lower temperatures. In its simplest form: (1) the material is heated to temperature $T_2$, which can be several hundred degrees below $T_T$ and $T_1$; (2) the solute is introduced into the material such that the composition moves along line OP of FIG. 3, thereby isothermally solution treating it into the beta phase field; (3) the solute is rapidly removed from the material (reversibly along line PO, for example), to isothermally "quench" the material; and (4) the material is cooled to room temperature using conventional means.

SUMMARY OF THE INVENTION

The present invention overcomes the problems and disadvantages of the prior art by providing a means for refining the microstructure of a metal casting where the metal has an elevated transformation temperature at which a first phase in the metal transforms to a second phase. The metal casting is heated to a treatment temperature near but below the transformation temperature. A solute material, having a physical effect such that it reduces the transformation temperature, is then diffused into the metal casting. The solute is diffused into the metal casting in a concentration such that it reduces the transformation temperature to at least that of the treatment temperature thereby inducing the transformation of the first phase of the metal into the second phase. The solute is then removed from the metal casting by diffusion at a rate sufficient to transform the second phase of the metal back to the first phase which has the result of refining the microstructure of the first phase when it is reformed. The solute is removed at a temperature above that at which it would form undesirable or detrimental compounds in the metal. Preferably, the metal is one from Group IVB of the Periodic Table, i.e., titanium, zirconium and hafnium.

The present invention finds particular utility in the treatment of titanium castings which comprise a mixture of hexagonal close-pack alpha and body-centered cubic beta, with all or a portion of the alpha having been formed from the beta phase. The microstructure of this portion of the alpha is refined by subsequently transforming the portion to beta by the diffusion of a material into the metal casting and thereafter diffusing out the material to induce an accelerated transformation of beta to alpha in this portion of the metal.

Preferably, the solute material diffused into the metal to induce the transformations is hydrogen.

The accompanying drawings and photomicrographs, which are incorporated in and constitute a part of this specification, illustrate the principles of the invention and its embodiments.

DESCRIPTION OF THE PREFERRED EMBODIMENTS

Figure 1:
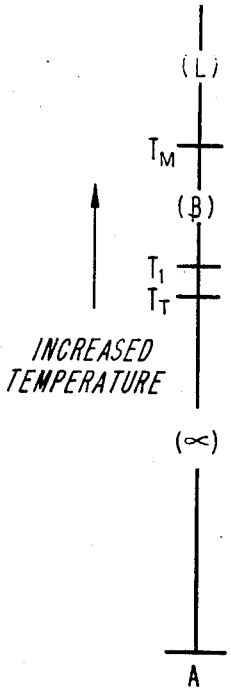
FIG. 1 is a schematic representation of the allotropic transformation of a metal as a function of temperature.
Figure 2:
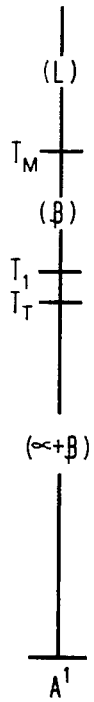
FIG. 2 is a schematic representation of a metal alloy depicting the phases presents as a function of temperature.

As noted above, the method of the present invention involves the diffusion of a solute material into a metal in order to promote a transformation in the metal. Subsequent removal of the solute results in the reversal of the transformation at a rate that beneficially affects the microstructure of the metal.

The method of the present invention finds particular utility in treating titanium alloys with hydrogen although the invention should be operable with other metal alloys and by diffusion of materials other than hydrogen.

On cooling from elevated temperature titanium and its alloys undergo an allotropic transformation from the body-centered-cubic (BCC) beta form to the hexagonal-close-packed (HCP) alpha form. The temperature of this transformation is affected by the presence of other elements and of those hydrogen has the advantage of being easily removed from the metal. Other metals that undergo allotropic transformations could also be treated in such a manner including the other Group IVB elements Zr and Hf. Other elements such as lithium and sodium or the lanthanide series (atomic numbers 58 through 73) may also be operable with the present invention. In particular, neodymium, holmium and praseodynium, which undergo a beta (BCC) to alpha (HCP) transformation would appear to be operable with the present invention.

The material that induces the transformation in the metal is referred to herein as the solute or the catalytic solute as it does not appear to take part in the transformation reaction and is contained in the final product only in trace amounts. While the exact mechanism by which the catalytic solute affects the transformation and hence the process embodiments of the invention is not completely understood, certain parameters concerning its behavior have been determined from a study of the use of hydrogen as the catalytic solute in titanium alloys. In general, it appears that the catalytic solute should reduce the temperature at which a high temperature phase is stable and in addition not react irreversibly with constituents to form compounds detrimental to the metal at the treatment temperatures.

To facilitate the process embodiments of the invention, the catalytic solute should be easily handled in an industrial environment. In addition, it should be sufficiently mobile at the processing temperature, such that it may be introduced and removed within time periods of practical interest. The actual extent of removal times, and the practicality thereof, will be a function of section size involved. For example, thin metallic coatings or the outer layers of composite laminates may be effectively treated in accordance with the invention within times of practical interest using a relatively slow moving catalytic solute species that would be unsuitable for treatment of a thicker section.

Although the present invention is primarily concerned with refining the microstructure throughout the entire cross section of cast components, and the ability to treat heavy sections is demonstrated by a later example, the technique may also be used as a means to modify the surfaces of castings. Where hydrogen is used as the catalytic solute, limiting the hydrogen partial pressure, or controlling the hydrogenation time at a given pressure, may be used to limit the catalytic solute addition to only the surface regions of a casting. After solute removal, the microstructural refinement and property modification would be restricted to surface regions, the depth of which would be determined by the hydrogenation process parameters that were employed.

In the treatment of reactive metals, the surface cleanliness of the material to be treated and the purity of the inert atmosphere under which it is processed must be carefully controlled. Surface contamination of reactive metal castings, such as by oxygen in the case of titanium, is not only deleterious to the article, but can result in a surface diffusion barrier which limits the rate at which a catalytic solute such as hydrogen can be introduced into and removed from the articles being treated.

In addition, care must be taken during practice of the invention to use proper combinations of temperature and composition to insure that undesirable intermediate phases are not formed in the material. Intermediate phases are often brittle and, by nature of their atomic volume differences with the base metal, can produce significant distortion and/or cracking of precision shaped components. For example, the formation of titanium hydride should be avoided when treating titanium alloys by hydrogenating and dehydrogenation.

In principle, a variety of low atomic number (e.g., less than about 16), and thus relatively mobile species might be used as the catalytic solute. Based on the considerations given above, however, hydrogen appears to be a particularly desirable catalytic solute especially for use with Group IVB elements and their alloys. Hydrogen increases the stability of the allotropic BCC phase relative to low temperature HCP phase since it is more soluble in the "relatively open" BCC structure. In addition, the element is a gas which can be easily handled using more or less conventional pumping systems, it exhibits a very high mobility (diffusion rate) in alloys of engineering interest, and the compounds it forms with Group IVB elements are relatively unstable. Titanium hydride, for example, appears to be stable only at temperatures below 1184° F. in the binary Ti-H system.

The temperature at which the catalytic solute should be added to the metal depends primarily on the degree by which the temperature of the desired transformation can be affected by the catalytic solute. Where small concentrations of catalytic solute are able to reduce the transformation temperature significantly there may be no need to heat the metal to a temperature close to its normal transformation temperature. The relationship between the composition of the metal being treated, the composition of the catalytic solute and the temperature at which the diffusion of the catalytic solute takes place has not been determined for all materials that would be operable with the present invention. One skilled in the art, however, may readily determine such relationships in light of the parameters applicable to titanium alloys set out herein.

For titanium alloys, the treatment temperature may be in the range of from 800° F. to 2000° F. and preferably in the range of 1200° F. to 1600° F. For the Ti-6Al-4V alloy, the preferred solute introduction temperature is in the range of from 1200° F. to 1550° F.

The level of catalytic solute addition is, as noted above, related to other factors and can readily be determined in light of the teachings of the present specification. For titanium metal and its alloys, the catalytic solute concentration where the catalytic solute is hydrogen may be in the range of from 0.2% to 5% by weight. Preferably, the range is 0.5% to 1.1% and for Ti-6Al-4V alloys it is preferred to be in the range of from 0.6% to 1.0%.

Although the effect of the partial pressure of the gaseous catalytic solute has not been completely determined and the examples given herein relate to charging hydrogen (hydrogenating) at partial pressures of up to 1.1 atmosphere (836 mm of mercury), charging the solute under hyperbaric conditions (e.g., 10 or even 1,000 atmospheres, as in a HIP unit), may be used as a means to accelerate the introduction of the solute at a given section size or to permit the introduction of greater amounts of catalytic solute at a given temperature.

The catalytic solute must in most systems be removed both in order to reverse the solute induced transformation and to eliminate detrimental effects of the solute on the properties of the metal. For titanium based materials using a hydrogen solute the rate of solute removal may be in excess of 0.01% per hour and preferably in excess of 0.1% per hour. For the Ti-6Al-4V alloy, the rate of hydrogen removal is preferably in the range of from 0.2% to 0.5% per hour. The solute may be removed in an inert atmosphere or a vacuum.

It should be understood that the solute removal rates referred to represent average values. Instantaneous or localized removal rates may be several orders of magnitude higher than average during the initial stages of dehydrogenation, and several orders of magnitude lower than average during the final stages of solute removal.

The temperature at which the catalytic solute is removed should be high enough that diffusion of the solute is facilitated, and it should be above the temperature at which deleterious phases are stable. The presence of large amounts of residual hydrogen in Group IVB alloys such as Ti-6Al-4V must be avoided Under normal circumstances, treatment should include sufficient time at temperatures above about 1200° F. under a vacuum level greater than about $10^{-4}$ torr to insure removal of the hydrogen to levels below about 150 ppm. An alternative method would be to initially dehydrogenate the material to a "safe" level from the standpoint of integrity and dimensional considerations (e.g., 800 ppm) in the hydrogenating furnace and then to perform a subsequent vacuum annealing operation employing a conventional vacuum heat treatment furnace.

The present invention is disclosed using titanium and hydrogen and in most examples an isothermal process where the treatment temperature and the solute removal temperatures are approximately the same. In the disclosed embodiment using Ti-6Al-4V, it is preferred that the solute removal temperature be in the range of from 1200° F. to 1550° F.

The treatment temperatures are related to the beta transus temperature and the present invention has been successfully practiced with a number of titanium alloys. Specifically the present invention has successfully refined the microstructure of the following titanium alloys: TI-6Al-4Zr-2Mo, Ti-8Al-1V-1Mo and Ti-5Al-2.5Sn.

Figure 3:
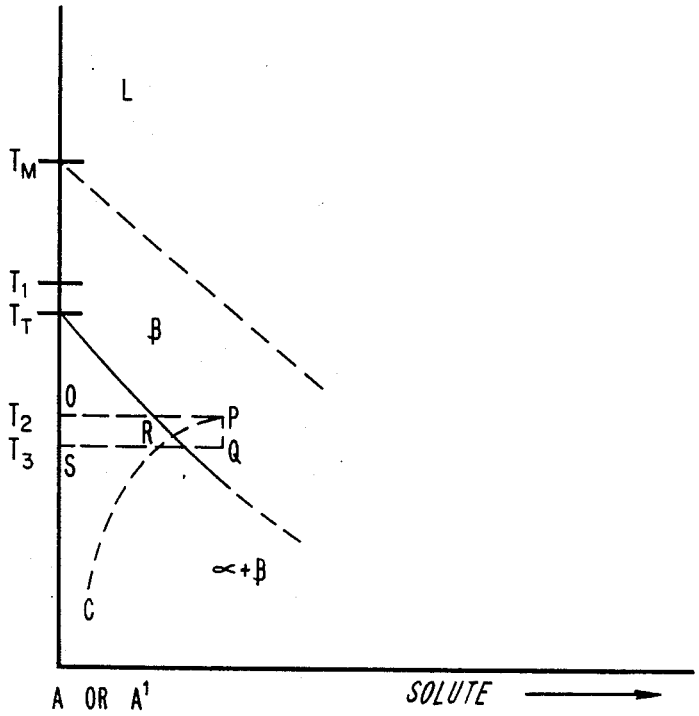
FIG. 3 is a phase diagram illustrating the relationship between the phases of a metal alloy with the increasing concentration of a removable solute dissolved therein.

The use of an isothermal or near isothermal solute removal step is not necessary. An alternative procedure is set out in FIG. 3. As an alternative to the isothermal process of heating the material to temperature $T_2$, charging catalyst along path OP, removing the catalyst along path PO, and cooling to room temperature, the following procedural variations may be used:

(1) To shorten the cycle time, the catalytic solute may be charged simultaneously with heating. This is schematically suggested by the path CP in FIG. 3. Removal of the catalyst solute may then occur at a temperature $T_2$ along path PO.

(2) Once point P has been reached, as an alternative to catalytic solute removal along path PO, the temperature could be reduced along path PQ to a temperature $T_3$, and then remove solute along path QRS or QRC. This would minimize the time necessary to introduce the desired amount of solute while maximizing the degree of microstructural refinement that is obtained, because the material would be "constitutionally quenched" at a lower processing temperature. This kind of cycle has been termed "near isothermal" processing, because $T_2$ and $T_3$ are both significantly below $T_T$ and $T_1$; substantially identical phase relationships exist at $T_2$ and $T_3$; and the absolute difference between $T_2$ and $T_3$ is significantly less than the difference between either $T_2$ or $T_3$ and 70° F. It should be noted, however, that in a practical sense $T_2$ and $T_3$ might differ by several hundred degrees.

Operation of the invention and its variants is further illustrated by the following examples; wherein the metal used to illustrate the invention is a cast Ti-6Al-4V alloy having the following composition:

CHEMICAL COMPOSITION OF CAST Ti-6Al-4V ALLOY

| Element | AMS 4928 Specification | Example Material |
|---|---|---|
| Ti | Bal | Bal |
| Al | 5.50–6.75 | 6.28 |
| V | 3.50–4.50 | 4.04 |
| Fe | 0.30 max. | 0.21 |
| C | 0.10 max. | 0.02 |
| O | 0.20 max. | 0.20 |
| N | 0.075 max. | 0.009 |
| H | 0.015 max. | 0.0006 |

EXAMPLE 1

Figure 4:
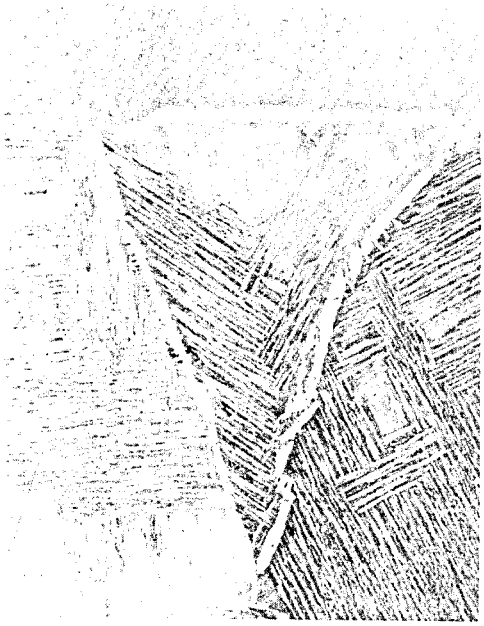
FIG. 4 is a photomicrograph of Ti-6Al-4V metal alloy in the as-cast condition at 200X.
Figure 5:
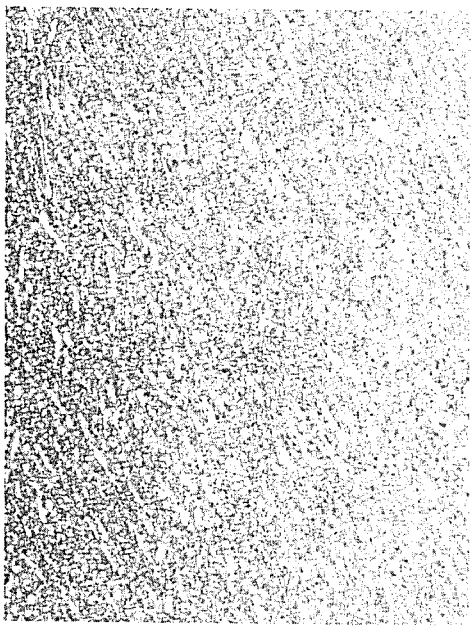
FIG. 5 is a photomicrograph of the same material of FIG. 4 after treatment by means of the present invention as described in Example 1.

Ti-6Al-4V, having the composition given above, was vacuum investment cast in metal oxide molds to provide $\frac{5}{8}$ inch diameter test bars and various precision shapes having section sizes of up to $1\frac{1}{8}$ inch. The following operations then were performed: (1) the material was loaded into a hydrogen/vacuum furnace at room temperature; (2) the system was pumped down to below $10^{-4}$ torr using standard argon backfill and repumping techniques; (3) the load was heated to approximately 1450° F. under vacuum; (4) the system was charged with pure hydrogen gas at a constant pressure of 1 psi gauge (15.7 psia) for a period of one hour to introduce approximately 0.8 percent by weight hydrogen into the material; (5) the system then was reevacuated at 1450° F. for a period of $2\frac{1}{2}$ hours first using a mechanical pump and 1300 $ft^3$/min "blower" combination and then employing a 6 inch diffusion pump to obtain a vacuum of about $10^{-4}$ torr; and (6) the load was cooled to room temperature and removed from the furnace. Metallographic examination of the subject material revealed substantial microstructural refinement compared to the as-cast starting material, as depicted in FIGS. 4 and 5.

EXAMPLE 2

Figure 6:
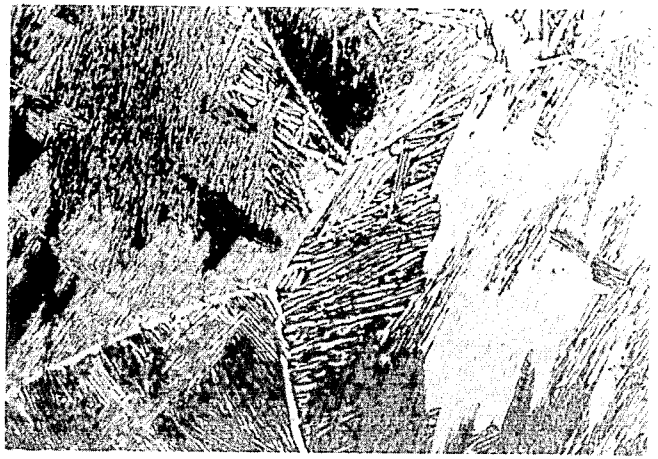
FIG. 6 is a photomicrograph of cast Ti-6Al-4V metal alloy which has received a hot isostatic pressure treatment at 1650° F.
Figure 7:
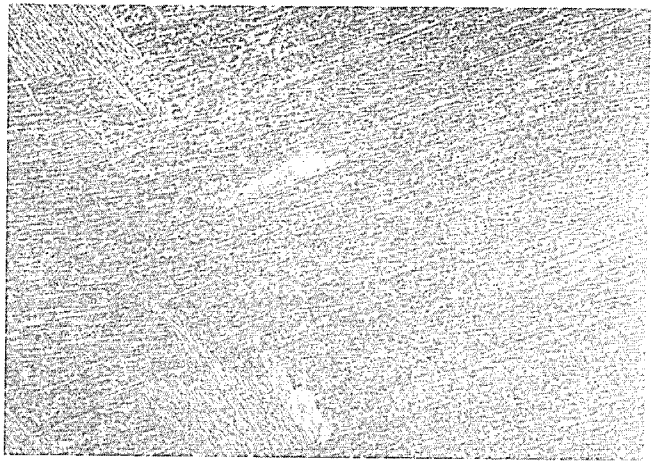
FIG. 7 is a alloy of FIG. 6 after a treatment by the method of the present invention at a constitutional quenching rate of 0.13% per hour, as described in Example 2.
Figure 8:
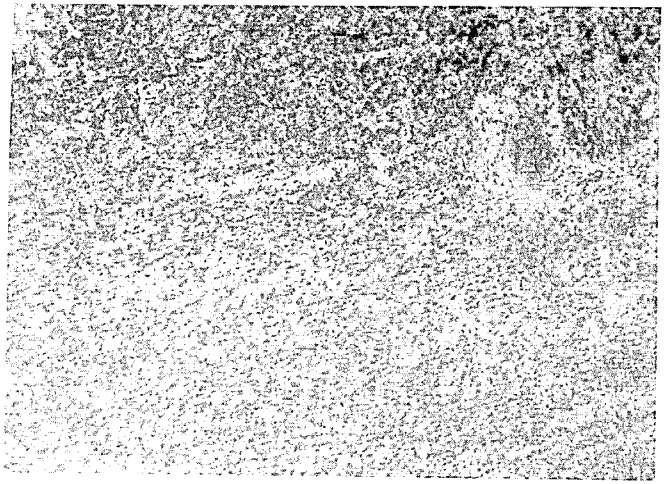
FIG. 8 is the same material as shown in FIGS. 6 and 7; however, this material has been treated by means of the present invention at a constitutional quenching rate of 0.32% per hour, as described in Example 2.

The as cast Ti-6Al-4V alloy test specimens and shapes described in Example 1 were hot isostatically pressed (HIP'ed) at 1650° F. and 15 ksi for two hours to substantially eliminate any shrinkage porosity present in the articles. The microstructure of this material is depicted in FIG. 6. The HIP'ed material then was subjected to 1450° F. isothermal treatment substantially identical to that described in Example 1, wherein hydrogen was introduced over a period of one hour to achieve about 0.8 percent by weight in the castings and the hydrogen was removed over a period of approximately $2\frac{1}{2}$ hours at 1450° F. prior to cooling to room temperature. A companion 1450° F. isothermal run also was performed in the same way, except that the hydrogen was removed over a period of six hours using a mechanical pump having only 17 $ft^3$/min capacity. Since approximately 0.8 percent by weight hydrogen was charged into the samples in both cases, the evacuation times corresponded to average "constitutional quenching rates" of approximately 0.13% per hour and 0.32% per hour, respectively. Metallographic examination of the product of these runs revealed significant microstructural refinement in both cases as depicted in FIGS. 7 and 8. The degree of refinement was significantly greater using the more rapid constitutional quenching rate of 0.32% per hour, as depicted in FIG. 8.

EXAMPLE 3

Figure 9:
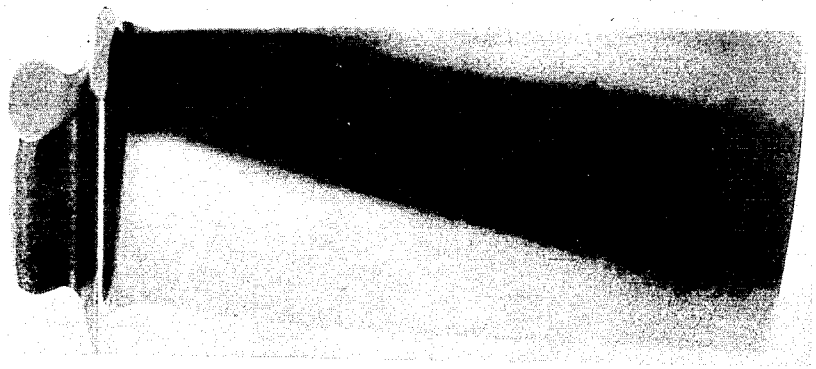
FIG. 9 is an enlarged (2.5X) photograph of a cast and electro-chemically machined gas turbine compressor blade of Ti-6Al-4V, as treated by the present invention as described in Example 3.

Several dozen gas turbine engine compressor blades were produced by: (1) casting oversized preforms; (2) chemically milling the preforms to remove 0.020 inch of material; (3) hot isostatically pressing the milled preforms at 1650° F. and 15 ksi for two hours; and (4) electrochemically machining them to final blade dimensions. A group of these components was processed in accordance with the present invention using a 1450° F. isothermal cycle as described in Example 1, except that approximately 1.0% hydrogen was introduced into the material and the solute was removed over a period of four hours, which corresponds to an average constitutional quenching rate of approximately 0.25% per hour Visual examination and dimensional inspection revealed that integral, dimensionally acceptable components were present after the treatment of the present invention, see FIG. 9. In addition, metallographic examination of the components revealed a substantial degree of microstructural refinement, in general agreement with the results shown in FIG. 8 for a prior run that was conducted using similar parameters.

Figure 10:
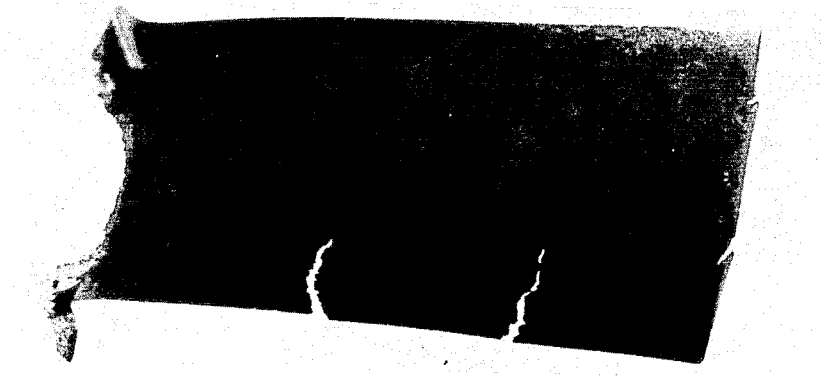
FIG. 10 is the same article as that shown in FIG. 9, except it was treated by the conventional hydride-dehydride process also described in Example 3.

A second group of these components then was processing using a hydriding cycle which involved the following steps: (1) the blades were heated to 1450° F.; (2) the blades were hydrogenated at 1 psig for a period of one hour; and (3) the blades were cooled to 1000° F. under hydrogen and then cooled to 70° F. under argon. This cycle differed from the treatment of the present invention in that the hydrogen solute was not removed at elevated temperatures, but rather the components were exposed to a temperature wherein significant amounts of titanium hydride could form. Extensive cracking and distortion effects resulted from this procedure, FIG. 10. No effort was made to complete the hydride/dehydride cycle by dehydrogenating the blade, because dimensional integrity had already been lost.

EXAMPLE 4

Figure 11:
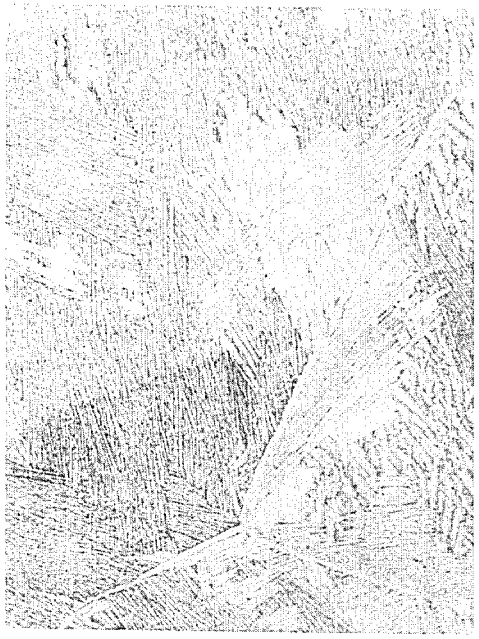
FIG. 11 is a photomicrograph of a cast Ti-6Al-4V alloy that has received a hot isostatic pressing at 1650° F. as described in Example 4.
Figure 12:
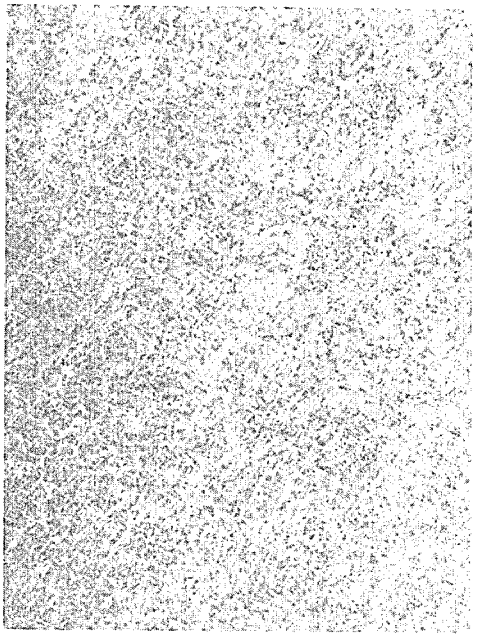
FIG. 12 is the same material as FIG. 11 after having received treatment by the present invention, as described in Example 4.

The cast and HIP'ed Ti-6Al-4V test material described in Example 2 was: (1) loaded into a hydrogen/vacuum furnace; (2) evacuated to below $10^{-4}$ torr; (3) heated to about 1550° F.; (4) charged with hydrogen at approximately 1 psig for a period of one hour; (5) cooled under hydrogen to a temperature of approximately 1200° F.; (6) dehydrogenated at 1200° F. over a period of two hours; and then (7) cooled to room temperature. Metallographic examination established that substantial microstructural refinement was obtained using this near isothermal process. The photomicrographs of FIGS. 11 and 12 demonstrate the results of this process. In addition, excellent integrity and dimensional retention were observed.

EXAMPLE 5

$1\frac{1}{8}$inch diameter bars of cast Ti-6Al-4V alloy were HIP'ed at 1650° F. and 15 ksi for two hours and treated according to the present invention in both an isothermal 1450° F. cycle and in a near isothermal cycle at 1550° F./1200° F. Uniform microstructural refinement was obtained throughout the entire cross section in every case. Ti-6Al-4V is not regarded as a deep hardenable alloy when conventional heat treatments are employed. Therefore, the data of this example establishes the utility of the present invention as a means to constitutionally solution treat and refine relatively heavy sections. The practical section size limitations, if any, of the present invention have not yet been established.

Mechanical Testing

In order to demonstrate the benefits of the present invention, the Ti-6AL-4V alloy set out in the preceding table was tested in the following manner.

Tensile Properties

A group of 0.250 inch diameter tensile test specimens were machined from the 5/8 inch diameter oversized test bars from the material treated in Example 2 at an average quenching rate of 0.32% per hour.

A second group of 0.250 inch diameter tensile test specimens were machined from the $\frac{5}{8}$ inch diameter oversized test bars from the material treated in Example 4. Testing at 70° F. established that the process of the present invention produced a 10 to 13 ksi increase in ultimate strength and a 16 to 19 ksi increase in yield strength, combined with up to a 40% reduction in room temperature tensile ductility.

Another processing trial was performed using the near isothermal cycle described above (1550° F./1200° F.), without introducing any hydrogen into the system, in an effort to determine the effect, if any, of the thermal processing cycle itself. No significant effects on room temperature tensile properties were observed. In addition, metallographic examination failed to reveal any measurable microstructural refinement.

70° F. TENSILE PROPERTIES OF CAST AND HIP'ED Ti-6AL-4V ALLOY

| Material Condition (1) | UTS (KSI) | 0.2% YS (KSI) | EL (%) | RA (%) |
|---|---|---|---|---|
| Control Material (2) | 143 | 124 | 14.3 | 24.2 |
| Treated according to the invention (3) | 155 | 137 | 12.6 | 22.3 |
| | 158 | 143 | 11.6 | 16.7 |
| | 156 | 140 | 12.1 | 19.5 |
| Treated according to the invention (4) | 154 | 147 | 6.4 | 9.9 |
| | 152 | 140 | 9.1 | 12.9 |
| | 154 | 142 | 9.7 | 22.1 |
| | 153 | 143 | 8.4 | 15.0 |
| Thermally Treated Only (5) | 141 | 126 | 12.0 | 18.2 |
| | 136 | 121 | 9.8 | 19.2 |
| | 138 | 122 | 13.3 | 25.9 |
| | 138 | 123 | 11.7 | 21.1 |

(1) After casting and HIP at 1650° F. and 15 ksi for two hours.
(2) Average of twelve tests performed for production heat acceptance and characterization purposes after 1550° F. anneal for two hours.
(3) Isothermal processing at 1450° F. with an average constitutional quenching rate of 0.32% per hour, as described in Example 2.
(4) Near isothermal processing at 1550° F./1200° F., as described in Example 4.
(5) Near isothermal processing at 1550° F./1200° F. without introduction of any hydrogen catalyst, as described in Example 4.

As shown by the above data, the present invention materially improves the ultimate tensile strength (UTS) and the yield strength (YS). While the ductility of the alloy was reduced as measured both by the precent elongation (EL) and percent reduction in area (RA), the decrease was not such that the alloy was rendered excessively brittle.

Fatigue Properties

Figure 13:
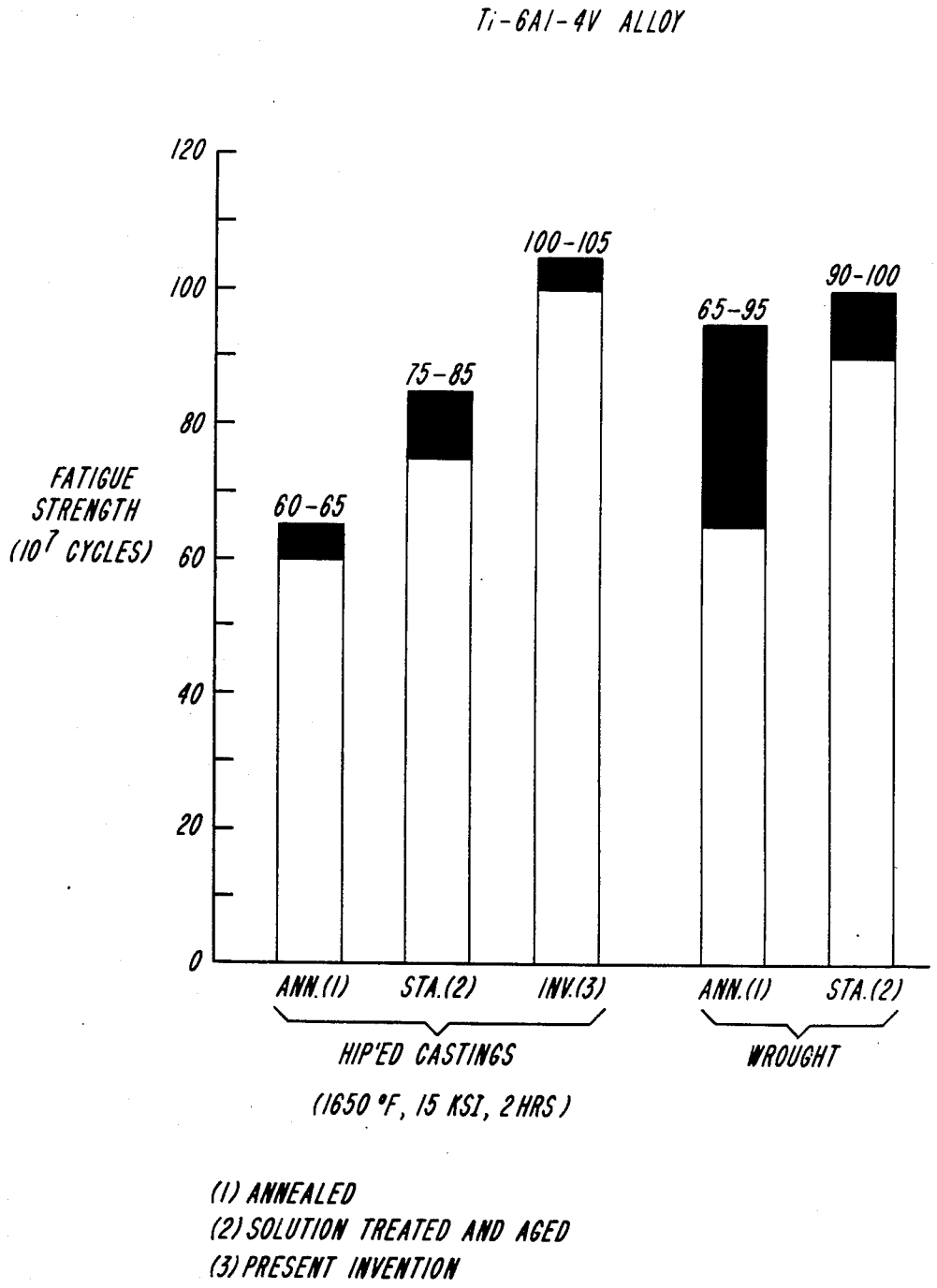
FIG. 13 is a graphic representation of the fatigue properties of conventionally treated materials compared to those treated by the present invention.

Two groups of $\frac{5}{8}$ inch diameter bars one of which had been treated in the 1450° F. isothermal run described in Example 4 using a 0.32% per hour quenching rate, and the other which had been treated in the 1550° F./1200° F. near isothermal run described in Example 4 were machine to provide high cycle fatigue test specimens. The samples were tested at 70° F. at a frequency of 30 HZ using an A ratio of 0.99. Baseline cast plus HIP'ed samples (no hydrogen treatment) were machined and tested from the same heat of alloy for comparison purposes. The results of this work are illustrated below and compared with the reported properties of wrought material in FIG. 13.

70° F. HIGH CYCLE FATIGUE PROPERTIES OF CAST AND HIP'ED Ti-6Al-4V ALLOY

| Material Condition(1) | Maximum Stress (ksi) | Cycle to Failure | Comments |
|---|---|---|---|
| Control Material(2) | 60 | $10^7$ | Did not fail |
| | 60 | $10^7$ | Did not fail |
| | 65 | $10^7$ | Did not fail |
| | 65 | $9.3 \times 10^6$ | |
| | 75 | $4.3 \times 10^5$ | |

-continued

70° F. HIGH CYCLE FATIGUE PROPERTIES OF CAST AND HIP'ED Ti-6Al-4V ALLOY

| Material Condition(1) | Maximum Stress (ksi) | Cycle to Failure | Comments |
|---|---|---|---|
| | 75 | $3.4 \times 10^5$ | |
| | 80 | $1.7 \times 10^5$ | |
| Treated According to the Invention(3) | 90 | $10^7$ | Did not fail |
| | 100 | $10^7$ | Did not fail |
| | 100 | $10^7$ | Did not fail |
| Treated According to the Invention(4) | 100 | $10^7$ | Did not fail |
| | 100 | $10^7$ | Did not fail |
| | 110 | $10^7$ | Did not fail |
| | 110 | $5.2 \times 10^6$ | |
| | 110 | $4.5 \times 10^6$ | |
| | 110 | $3.7 \times 10^6$ | |
| | 110 | $2.2 \times 10^6$ | |

(1)After casting and HIP at 1650° F. and 15 ksi for two hours.
(2)Tests performed for production heat characterization purposes after 1550° F. anneal for two hours.
(3)Isothermal processing at 1450° F. with an average constitutional quenching rate of 0.32% per hour, as described in Example 2.
(4)Near isothermal processing at 1550° F./1200° F., as described in Example 4.

The material treated by the present invention demonstrated a stress for $10^7$ cycles endurance in excess of 100 ksi. This compared very favorably to the 60 ksi fatigue strength of cast and HIP'ed baseline material obtained from previously tested material, FIG. 13. See, Technical Bulletin TB 1660, Howmet Turbine Components Corporation, "Investment Cast Ti-6Al-4V." In addition, technical literature suggests that the fatigue strength capability of wrought Ti-6Al-4V alloy mill products varies from approximately 65 ksi to 95 ksi (C. A. Celto, B. A. Kosmal, D. Eylon, and F. H. Froes, "Titanium Powder Metallurgy—A Perspective," *Journal of Metals,* September 1980). Comparison of the above data with this literature data indicates that castings which are processed in accordance with the present invention have fatigue strength capabilities which are competitive with, or greater than, those of forged material.

The microstructual refinement achieved by the present invention may, in certain circumstances, produce an undesirable combination of strength and ductility properties for a specific application. In such situations the microstructural refinement achieved by the process embodiment of the present invention could be combined with subsequent heat treatments to achieve a balance of properties better suited to the desired application of the treated material. For example, the treated material could be subjected to conventional solution and aging treatments (above or below the beta transus in the case of titanium) or annealing processes, or combinations thereof. It is also possible to utilize multiple cycles combining the present invention with more conventional heat treatments in cyclic or multiple steps.

Use of the present invention would not normally refine the prior beta grain size of a casting. Therefore, the benefits of the invention are best combined with optimum casting technology producing fine grain castings.

Although the present invention is particularly suited for net shape castings, it should be understood that the invention is applicable to simple cast shapes, such as ingot castings. The present invention may be used to refine their microstructure and to produce an article that is more desirable as an input stock for subsequent forging operations. One benefit would be that the degree of necessary "breakdown operations" would be reduced. In addition, the present invention could be applied to precision or machined forgings which have been improperly heat treated, as a means to attain useful microstructures and high mechanical property capabilities. This would eliminate the need for further deformation processing which might be impractical or impossible and avoid exposing the article to elevated temperatures that are sufficiently high to solution anneal, distort, contaminate or otherwise impair the material.

An additional advantage of a material treated according to the present invention is that the resultance microstructural refinement lessens the attenuation of energy passing through the treated material. This facilitates the non-destructive testing of the treated material by such methods as ultrasonic inspection, radiography, eddy current and other techniques that input energy to the material and attempt to locate flaws by monitoring the manner in which the energy is absorbed or reflected.

The present invention can be applied to a broad variety of cast materials, including situations where solidification has occurred in a local or restricted region, such as with weldments, plasma or other molten metal deposits, and liquid phase sintered materials. The present invention finds particular utility in applications where cast metals and alloys were not previously suitable. Components (and portions thereof) for gas turbine and other heat engines as well as implanted medical prosthesis are particularly suited as applications of the present invention because of the physical properties of materials treated in accordance with the present invention.

The present invention is also useful in treating input material for other forming or shaping operations. For example cast ingots can be treated according to the present invention. As a result subsequent operations such as forging, rolling, extrusion, wire drawing, etc. are facilitated because of the microstructure of the treated material. Such a technique finds particular utility in forming components for heat engines such as gas turbines, where mechanical deformation to refine the microstructure ("breakdown operations") is reduced or eliminated.

Other applications for the present invention may be devised and the scope of the invention should not be limited solely to the embodiments disclosed.

What is claimed is:

1. A method of refining the microstructure of a metal casting, said metal having an elevated transformation temperature at which a first phase transforms to a second phase, said method comprising the steps of:

heating said metal casting to a treatment temperature near, but below, said transformation temperature;

diffusing a solute material into said metal casting, said solute having a physical effect such that it reduces said transformation temperature, said solute having a concentration in said metal such that it reduces said transformation temperature to at least said treatment temperature, said solute thereby inducing said transformation of said first phase to said second phase;

maintaining said metal casting at a temperature above that at which said solute would form detrimental compounds in said metal throughout said method; and removing said solute from said metal casting by diffusion to transform said second phase back to said first phase with said first phase having a refined microstructure.

2. The method of claim 1 wherein said metal comprises a metal from Group IVB of the Periodic Table.

3. The method of claim 1 wherein said metal comprises titanium.

4. The method of claim 1 wherein said transformation is an allotropic transformation.

5. The method of claim 1 wherein said metal comprises titanium and said metal casting at room temperature comprises a mixture of (HCP) alpha and (BCC) beta, at least a portion of said alpha having been formed from beta during cooling, the microstructure of said portion of alpha being refined by subsequently transforming said portion to beta by the diffusion of a solute material into said metal casting and thereafter diffusing out said solute to induce an accelerated transformation of beta to alpha in said portion.

6. The method of claims 1 wherein said solute material is hydrogen.

7. The method of claim 3 wherein said metal casting consists essentially of Ti-6Al-4V.

8. The method of claim 3 wherein said metal casting includes beta stabilizers.

9. The method of claim 1 including the step of hot isostatically pressing said metal casting.

10. The method of claim 1 including thermally treating said metal castings after or during removal of said solute material.

11. A metal article having been treated by the method of claim 1.

12. The metal article of claim 11 wherein said article is an ingot, said ingot being subsequently formed into a component for a heat engine.

13. A method of refining the microstructure of a metal casting, said metal having an elevated transformation temperature at which a first phase transforms to a second phase, said method comprising the steps of:

heating said casting to a treatment temperature near, but below, said transformation temperature;

diffusing a solute material into said metal casting, said solute having a physical effect such that it reduces said transformation temperature, said solute having a concentration in said metal such that it reduces said transformation temperature to at least said treatment temperature, said solute thereby inducing said transformation of said first phase to said second phase; and removing said solute from said metal casting by diffusion while simultaneously cooling said casting to induce transformation of said second phase back to said first phase and refine the microstructure of said first phase, the temperature of said metal casting remaining, when said solute is present in more than trace amounts, above that at which said solute would form detrimental compounds in said metal casting.

14. The method of claim 13 wherein said casting consists essentially of Ti-6Al-4V and said material is hydrogen.

15. The method of claim 13 wherein said metal comprises titanium and said solute is hydrogen.

16. The method of claim 13 wherein said metal casting is an ingot, and said method includes the subsequent step for forming said ingot into another shape.

17. The method of claim 16 where said forming step comprises forging.

18. A metal article having been treated by the method of claim 15.

19. A metal article having been treated by the method of claim 13.

20. A component for a heat engine treated by the method of claim 13.

21. A medical prosthesis treated by the method of claim 13.

* * * * *